US005881334A

United States Patent [19]

Maruta et al.

[11] Patent Number: 5,881,334

[45] Date of Patent: Mar. 9, 1999

[54] IMAGE FORMING APPARATUS AND METHOD FOR PREVENTING WASTED TONER

[75] Inventors: Takayuki Maruta; Takako Maruta, both of Yokohama, Japan

[73] Assignee: Ricoh Company, Ltd., Tokyo, Japan

[21] Appl. No.: 922,547

[22] Filed: Sep. 3, 1997

[30] Foreign Application Priority Data

| | | | |
|---|---|---|---|
| Nov. 29, 1996 | [JP] | Japan | 8-318912 |
| Jan. 8, 1997 | [JP] | Japan | 9-001240 |
| May 28, 1997 | [JP] | Japan | 9-138202 |

[51] Int. Cl.[6] ..... G03G 15/08

[52] U.S. Cl. ..... 399/18; 399/21; 399/46

[58] Field of Search ..... 399/18, 21, 50, 399/476, 127, 32, 168, 53, 55

[56] References Cited

FOREIGN PATENT DOCUMENTS

| | | | |
|---|---|---|---|
| 1109373 | 4/1989 | Japan | G03G 15/04 |
| 1138571 | 5/1989 | Japan | G03G 15/00 |
| 2-275478 | 11/1990 | Japan . | |
| 3261963 | 11/1991 | Japan | G03G 15/00 |
| 7-281500 | 10/1995 | Japan . | |
| 07333991 | 12/1995 | Japan | G03G 15/08 |
| 8-202205 | 8/1996 | Japan . | |
| 8-221730 | 8/1996 | Japan . | |

*Primary Examiner*—Arthur T. Grimley
*Assistant Examiner*—Quana Grainger
*Attorney, Agent, or Firm*—Cooper & Dunham LLP

[57] ABSTRACT

An image forming apparatus includes an image bearing member, a charging station, an exposure station forming an electrostatic latent image on the charged image bearing member, and a developing station for developing the latent image formed on the surface of the image bearing member. A stop control device is provided for immediately stopping a charging operation by the charging device when the image forming apparatus must stop due to the detection of an irregular state during an image forming process. The image bearing member continues moving by at least the distance along that member from the charging to the developing station before the stop control device stops the developing operation and the moving of the image bearing member.

19 Claims, 4 Drawing Sheets

IMAGE FORMING APPARATUS AND METHOD FOR PREVENTING WASTED TONER

BACKGROUND OF THE INVENTION

1. Field of the Invention

The invention relates to an image forming apparatus and method. More particularly, the invention relates to an image forming apparatus such as copying machine, facsimile machine, printer, and the like for forming images utilizing an electrophotographic process.

2. Background

In recent years, in an image forming apparatus utilizing an electrophotographic process, a method for developing an electrostatic latent image on a photoconductive element by a dry type developing method using a drum-shape or belt-shape photoconductive element as an image bearing member is becoming widespread. The process produces a visible image by charging the photoconductive element by a charging device, forming a latent image by exposing the photoconductive element using an optical system including laser light, and developing the latent image by a developing device. When a sheet (hereinafter a sheet is a recording paper) jam or some other error occurs during the image forming process, typically the entire image forming apparatus is stopped.

However, because of the inertia of some components, developing can continue until the apparatus comes to a complete stop. This often results in needless consumption of toner. Especially in recent years, color copying machines have spread remarkably and some kinds of machines have a heavy flywheel or the like on a shaft of the photoconductive element to improve image quality by decreasing banding (a deviation in a line-to-line distance in a sub-scanning direction). In this kind of image forming apparatus, since a rotating shaft of the photoconductive element has a considerable inertial moment, it takes time until the photoconductive element stops when the entire image forming apparatus is commanded to stop during the image forming process. Therefore, even though each operation, such as a charging operation, a photoconductive element drive, a developing bias, and a developing device drive are commanded to stop at the same time, the area of the surface of the photoconductive element which is already charged (the area corresponding to a distance from a charging position to a developing position of the photoconductive element) passes through the developing station when the developing bias is off, and developer (a carrier and a toner) is delivered to the above-mentioned area of the photoconductive element.

In view of this, for example, according to Japanese Laid-Open patent Application No. 261963/1991, in response to an emergency condition instructions to stop development and to stop the photoconductive element are given at different times, considering the time difference between stopping times of the photoconductive element and the developing device (because their inertial moments differ, and there is a difference between stopping times of the motors). However, this may not be enough to prevent needless toner usage after turning on the apparatus again.

Further, in color copying machines which spread in recent years, an A.C. bias is superimposed on a D.C. bias for the purpose of improving image quality and developing ability. The developing bias method as described above tends to cause even more needless usage of toner in the case of an emergency stop of the image forming process.

SUMMARY OF THE INVENTION

In view of the above-mentioned considerations, it is an object of the present invention to provide an image forming apparatus which produces a high quality image by reducing background staining due to needless usage of a developer on an image bearing member when an image forming process has to be stopped quickly.

In a non-limiting example embodying certain aspects of the invention, an image bearing member is driven in a selected direction. A charging device charges a surface of the image bearing member. An exposing device forms an electrostatic latent image on the charged image bearing member. A developing device develops the latent image formed on the surface of the image bearing member.

A stop control device is provided for immediately stopping charging but the image bearing member still is moved at least by the distance along that member from the charging device to the developing device before developing is stopped and the image bearing member stops its motion.

The stop control device can immediately stop superimposing an AC bias superimposed on a DC bias for developing the electrostatic latent image formed on the surface of the image bearing member.

BRIEF DESCRIPTION OF THE DRAWINGS

A more complete appreciation of the invention and the attendant advantages thereof will be readily obtained by referring to the following detailed description when considered in connection with the accompanying drawings, wherein.

DESCRIPTION OF THE PREFERRED EMBODIMENTS

First Embodiment

Figure 1:
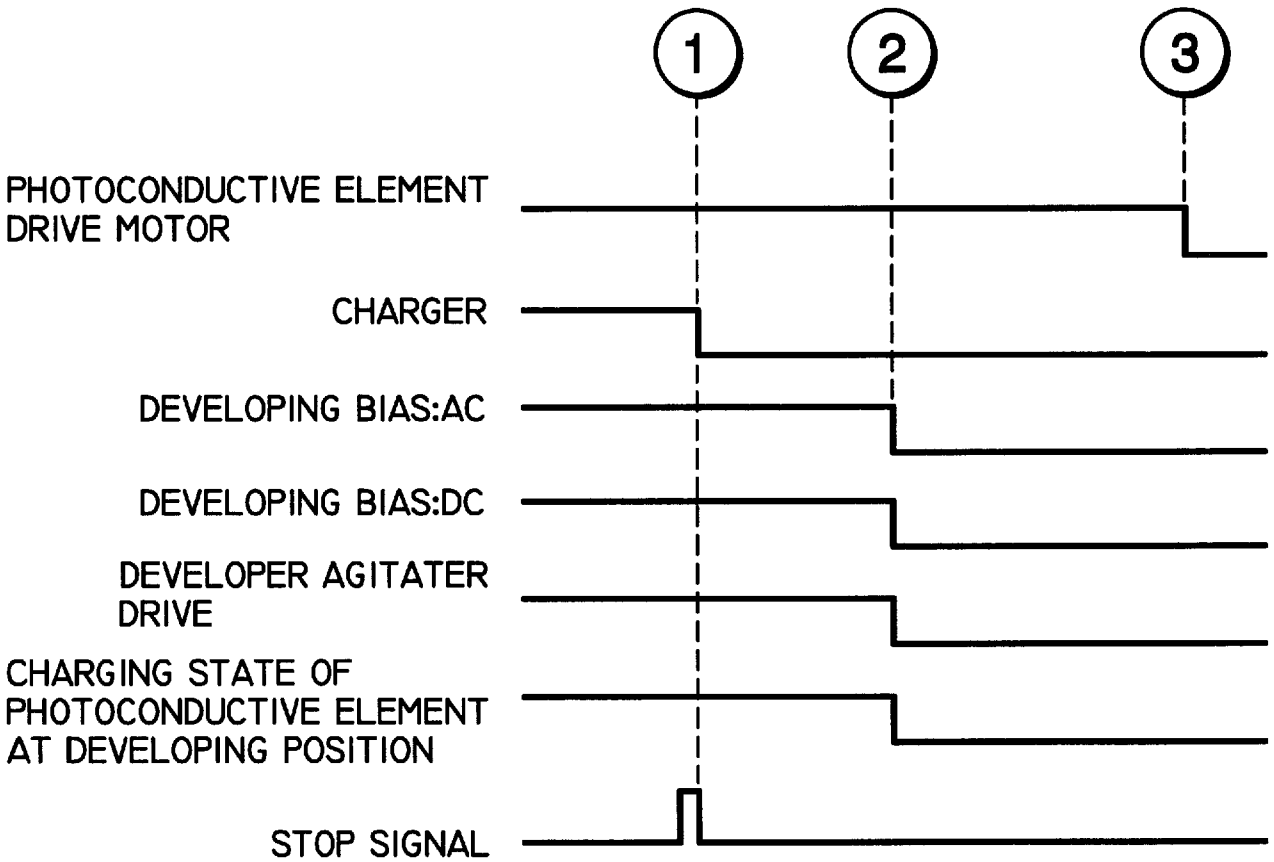
FIG. 1 is a time chart showing a stopping sequence of a first embodiment of the present invention.
Figure 2:
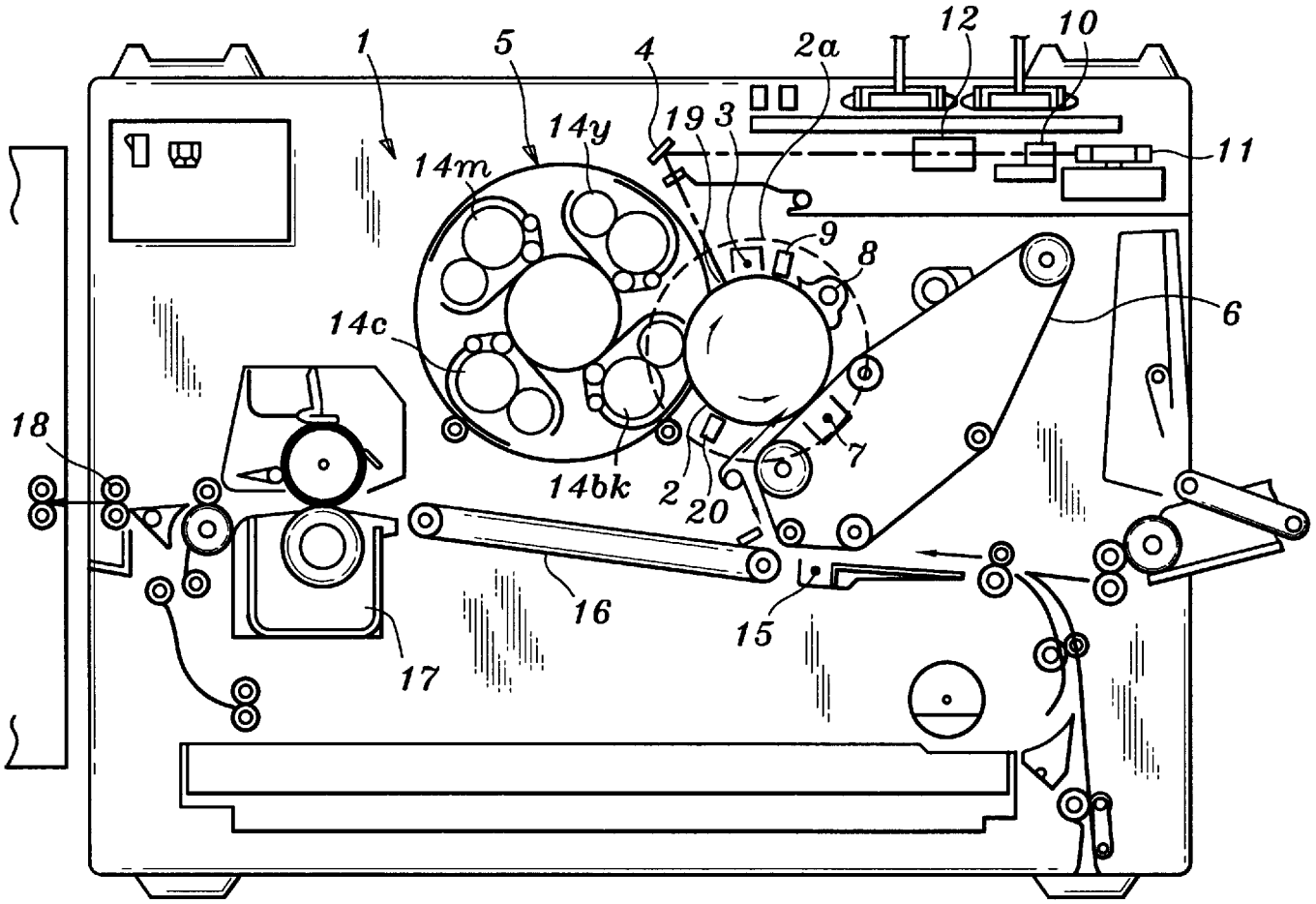
FIG. 2 is a schematic side elevation showing a construction of a color printer.
Figure 3:
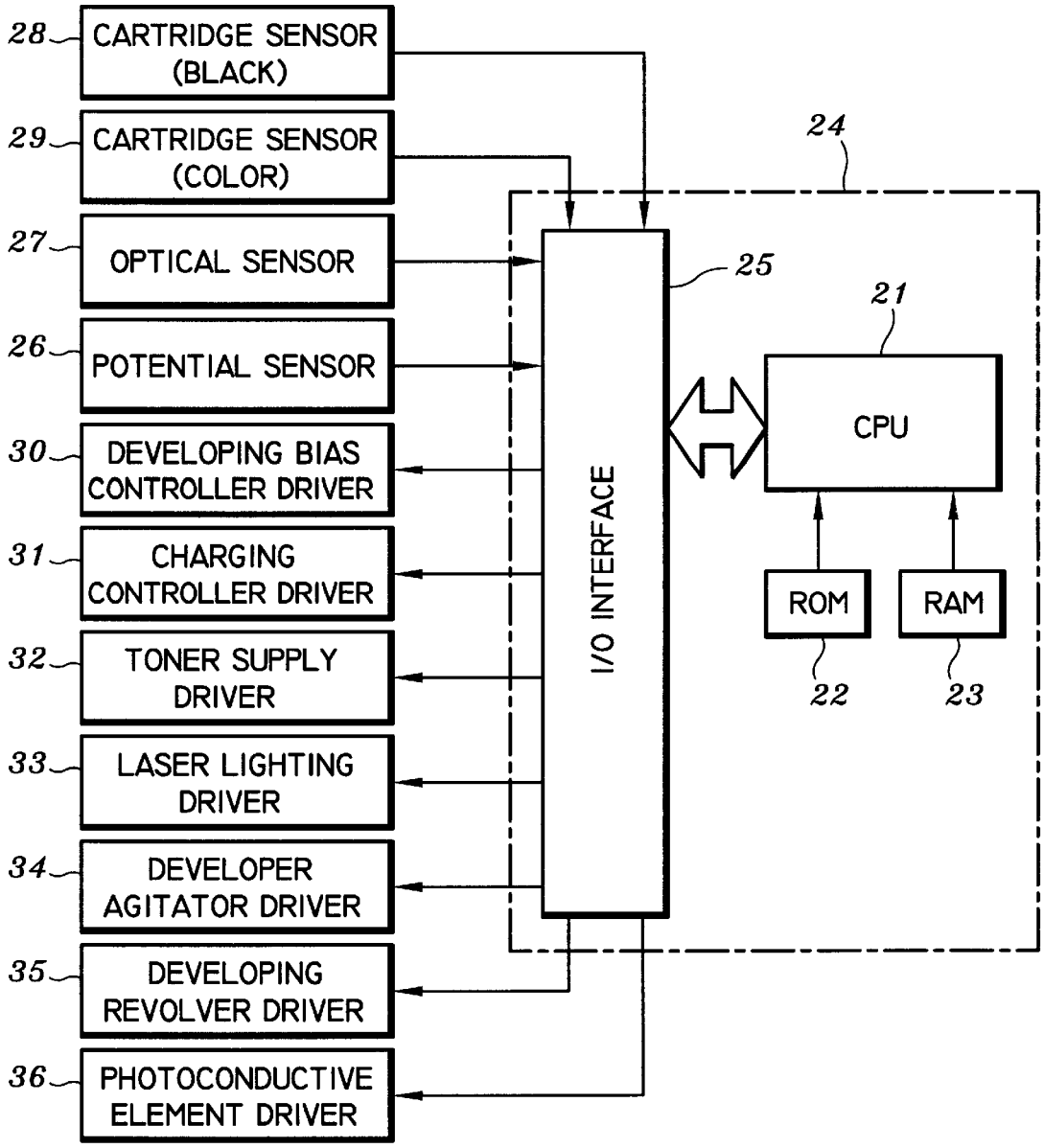
FIG. 3 is a block diagram showing a control system.

A first exemplary embodiment of the present invention is explained hereinbelow with reference to FIGS. 1 through 3, illustrating the invention as applied to a color digital copying machine. The construction of a color printer and its operation in the color digital copying machine are explained with reference to FIG. 2. This color printer 1 is a full color printer utilizing an electrophotographic method, and uses a photoconductive element 2 in the form of a drum-shaped image bearing member. A flywheel 2*a* having a weight of 5 to 10 times greater than the weight of the photoconductive element 2 is mounted on a shaft which is coaxial with the photoconductive element 2. The same shaft supports the photoconductive element 2 on the main body of the color digital copying machine. The photoconductive element 2 in this example has a diameter of 90 mm and a circumferential length of 283 mm, and the photoconductive element 2 rotates more than about 30 mm in circumferential distance by inertia after a photoconductive element drive motor (not shown) is stopped, in part due to the inertia of the flywheel 2*a* on the same shaft. Around the photoconductive element 2, according to the electrophotographic process, are arranged a charger 3 serving as a charging device, an optical writing unit 4 serving as an exposing device, a developing unit 5, a transfer charger 7 with an intermediate transfer belt 6, cleaning unit 8, and a discharging lamp 9 and the like in that order.

The optical writing unit 4 includes a laser lighting device 10, a polygon mirror 11, and an Fθ (theta) lens 12, to generates an optical signal (e.g., laser) from color image data and form an electrostatic latent image on the photoconductive element 2.

A rotating type developing unit called a revolver type developing unit is used as the developing unit 5 to supply the required developing colors to the photoconductive element 2 in the appropriate sequence, and is rotated as needed for the purpose of enabling full color development, thus keeping the device compact. Namely, a black developing device 14Bk, a cyan developing device 14C, a magenta developing device 14M, and a yellow developing device 14Y are disposed at ninety degrees intervals in sequential order around the rotation center of the developing unit 5. Further, not shown in the figure, a revolver rotation drive section for rotating the developing unit is provided. Each developing device 14 is composed of a developing sleeve which rotates to deliver developer to the surface of the photoconductive element 2 so that the electrostatic latent image is developed, and has a developing paddle and a screw paddle which rotate and serve as an agitating mechanism so that the developer is drawn up and agitated.

The aforementioned intermediate transfer belt 6 is passed around a plurality of rollers and is rotation driven in a clockwise direction. In this example, belt 6 is made of ETFE (ethylene-tetrafluoro-ethylene) having a moderate resistance of about $10^8$ to $10^{10}$ $\Omega/cm^2$.

The developing unit 5 is set at a position in which the black developing device 14Bk is facing the photoconductive element 2 in a waiting state. When a copying operation is started, a reading operation for black image is started from a predetermined timing at the scanner side. Then, optical writing and latent image forming by the laser light is started on the basis of the image data. The black latent image is developed by a black toner by starting a rotation of the developing sleeve before the leading edge of the black latent image reaches the developing position of the black developing device 14Bk so that the image can be developed from the leading edge of the black latent image formed by the operation. The developing operation of the black latent image area continues; however, when the trailing edge of the black latent image has passed the black developing position, the developing unit 5 immediately rotates from the developing position of the black developing device 14Bk to the developing position of the next color—the cyan developing device 14C, and similar operations take place for the other colors. This operation ends before the tip end portion of the latent image formed by the next image data reaches the developing station.

When an image forming cycle starts, the photoconductive element 2 is rotated in a counterclockwise direction and the intermediate transfer belt 6 is rotated in a clockwise direction. The image formation of the black toner along the rotation of the intermediate transfer belt 6, the image formation of the cyan toner, the image formation of the magenta toner, and the image formation of the yellow toner are executed in that order. Finally, the toner image is formed by superimposing each of the toner images in the order of Bk C M Y, on the intermediate transfer belt 6.

The toner in the developing unit 5 is charged to minus polarity by being agitated with ferrite carrier, and a minus potential DC bias and a superimposed AC bias are applied to the developing sleeve relative to the metal-substrate layer of the photoconductive element 2 by a power source device (not shown). The photoconductive element 2 is charged to minus polarity, and as a result, toner is not attracted to those parts of the photoconductive element which remain charged, but is attracted to parts where there is no charge, namely, at an exposed part, to form a developed visual image matching the latent image.

The toner image formed on the photoconductive element 2 is transferred by transfer charger 7 onto the surface of the intermediate transfer belt 6 which is driven at a uniform velocity in contact with the photoconductive member. A transferred image of four superimposed colors is formed on the intermediate transfer belt 6 by aligning the position of each of the color toner images which are formed on the photoconductive element 2 in order. Then, the four color image is transferred from the belt 6 onto a sheet, fed from a sheet feeding cassette, using for that purpose a corona charging transfer device 15. The sheet carrying the transferred image is discharged through a conveying belt 16, fixing unit 17, and discharging rollers 18 and the like, after the image is fixed by the fixing unit 17.

Next, a schematic of a electric control system is explained with reference to FIG. 3. There is provided a controller 24 including a CPU 21 which executes arithmetic operations and carries out control processing, a ROM 22 which stores a basic program for the arithmetic operations and control processing and basic data for processing programs, and a RAM 23 for inputting data. Operation control for the color printer 1, a scanner and the like are executed by the controller 24. External devices are connected to the CPU 21 via an I/O interface 25. A potential sensor 26, an optical sensor (so called P sensor) 27, another optical sensor for detecting the toner cartridge for black toner 28, and yet another optical sensor for detecting a toner cartridge for color toner 29, are connected to the input side of the I/O interface 25. Further, at an output side of the I/O interface 25, a developing bias controller driver 30, a charging controller driver 31, a toner supply driver 32, a laser lighting driver 33, a developer agitator driver 34, a developing revolver driver (a developing unit rotation driver) 35 and a photoconductive element driver 36 are connected.

In this embodiment, the function of a stop control device is executed by controller 24. The stop control device carries out the function of: (a) immediately stopping the charging operation of the charger 3, under the control of charging controller driver 31, when the entire image forming apparatus needs to be stopped during an image forming process on the basis of a sensor output such as jam detecting sensor, door open/close sensor, or the like: (b) stopping the photoconductive element 2 but only after moving it by at least the distance along the surface of the photoconductive element 2 from the charging position of the charger 3 to the developing position of the developing unit 5; and (c) stopping at least the DC bias supplied to the developing unit 5 only after the charged portion of member 2 has passed through the developing station. Thus controller 24 serves the function of executing a stopping operation which in sequence stops the developing operation of the developing unit 5 and the moving operation (rotation) of the photoconductive element 2 by controlling the developer agitator driver 34, developing bias controller driver 30 and photoconductive element driver 36.

In the construction as described above, an exemplary stopping sequence for stopping the operation of each part due to an event such as detecting a sheet jam or opening the door during the image forming process, is shown in FIG. 1. When the need for an emergency stop signal is detected, the stop control device of the controller 24 provides a stop signal, and the charging operation of the charger 3 is immediately stopped (timing ①) by controlling the charging control driver 31. At this moment, the surface of the photoconductive element 2 from the charging position of the charger 3 to the developing position of the developing unit 5 has been charged. The stop control device of the present embodiment continues to drive of the photoconductive element drive motor and the developing operation of the developing unit 5 continues until the trailing edge of the charged area passes through the developing position. When the trailing edge of the charged area reaches the developing position (timing ②), control unit 24 stops the developing operation by a developer agitator driver 34 and commands a developing bias controller driver 30 to discontinue the developing unit bias. At a later time (timing ③), control unit 24 stops the photoconductive element 2 by stopping the photoconductive element drive motor through controlling a photoconductive element driver 36.

The photoconductive element drive motor may be stopped at the time of stopping the developing operation if this occurs after the trailing edge of the charged area has passed through the developing position.

Therefore, according to the present embodiment, since the developing operation and the moving operation of the photoconductive element 2 continue as usual until after the charged area has passed through the developing position, the image forming apparatus can be stopped without undue accumulation of toner on the charged area of the photoconductive element 2. Consequently, the needless consumption of toner can be suppressed.

Second Embodiment

Figure 4:
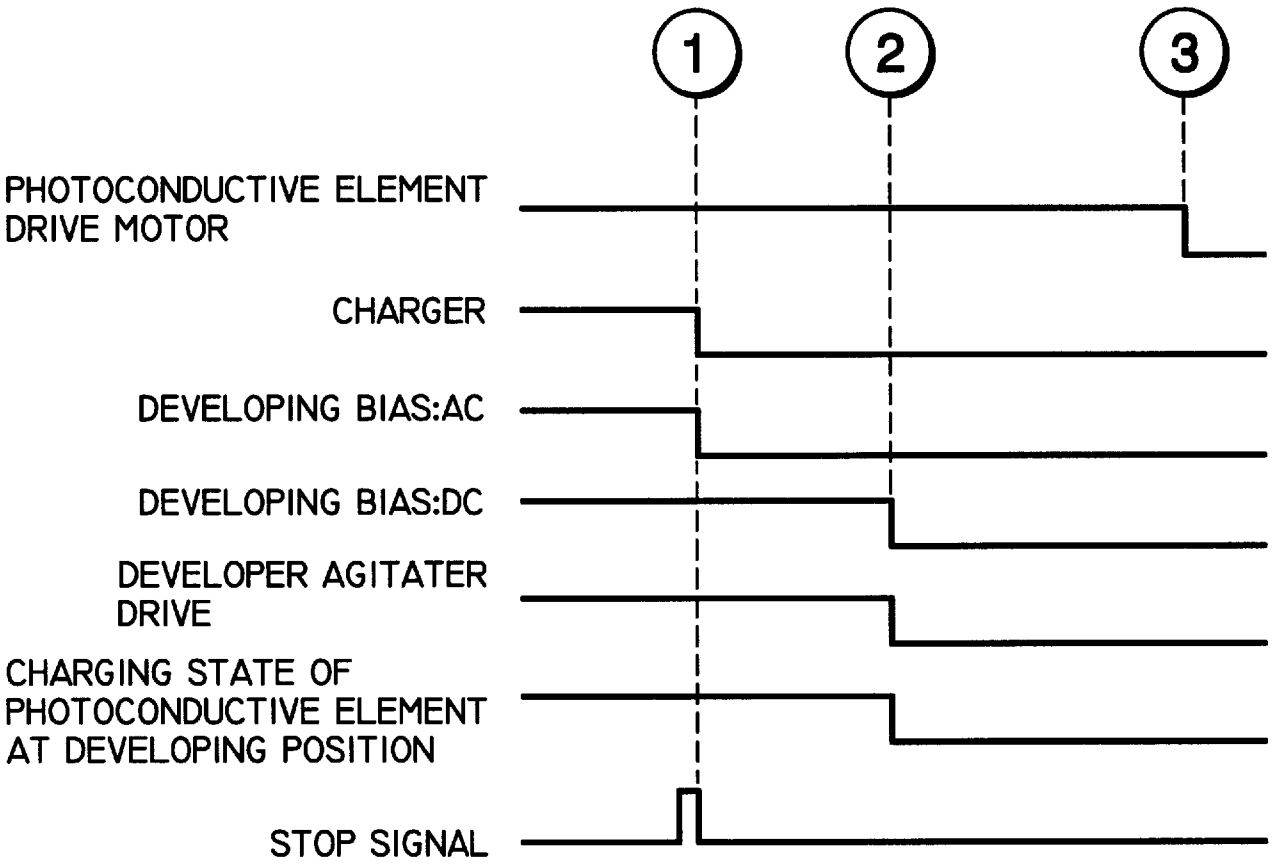
FIG. 4 is a time chart showing a stopping sequence of a second embodiment of the present invention.

A second embodiment of the present invention is explained with reference to FIG. 4. The same numerals represent the same elements of FIG. 1 through FIG. 3, and repetitive explanation is omitted. In this embodiment, the stop control device stops at the same time: (a) the charging operation of the charger 3: and (b) the AC bias of the developing bias.

Namely, the stopping sequence for an emergency stop in this embodiment is as follows. The charging operation by the charger 3 is stopped immediately at the timing ①, and the developing bias controller driver 30 is also controlled as the same timing ① to stop superimposing the AC bias. The developing operation with only the DC bias continues. The sequence control is otherwise the same as the first embodiment.

Therefore, in the second embodiment, the DC bias developing operation and the moving operation of the photoconductive element 2 continue as usual until the charged area has passed through the developing position. However, since developing is powered down by stopping the superimposing of the AC bias as a developing bias but the DC bias stays on as explained, the image forming apparatus can come to a complete stop without undue toner accumulation which can cause background stains on the image at the charged area on the photoconductive element 2 or needless toner usage including use of toner at the transition between the charged area and non-charged area. If the DC bias is turned off or switched, there is some possibility in this embodiment of depositing carrier on to the photoconductive element 2. However, if only the AC bias is turned off but the DC bias stays at the same level as explained, the developing ability is decreased without such carrier deposition. This obviates undue toner deposits on the photoconductive element 2 at the next start of the image forming apparatus.

This invention may be conveniently implemented using a conventional general purpose digital computer or microprocessor programmed according to the teachings of the present specification, as will be apparent to those skilled in the computer arts. Appropriate software coding can readily be prepared by skilled programmers based on the teachings of the present disclosure, as will be apparent to those skilled in the software arts. The invention may also be implemented by the use of application-specific integrated circuits or by interconnecting an appropriate network of conventional component circuits, as will be readily apparent to those skilled in the art.

Numerous modifications to and variations of the present invention are possible in light of the above teachings. It is therefore to be understood that within the scope of the appended claims, the invention may be practiced otherwise than as specifically described herein.

Having now fully described the invention, it will be apparent to one of ordinary skill in the art that many changes and modifications can be made thereto without departing from the spirit and scope of the invention as set forth herein.

This application is based on Japanese Patent Application No. 08-318912, filed on Nov. 29, 1996, No. 09-001240, filed on Jan. 8, No. 09-138202, filed on May 28, the entire contents of which is herein incorporated by reference.

What is claimed is:

1. An image forming apparatus comprising:

a charging station, an exposing station, and a developing station;

an image bearing member;

a driver for driving the image bearing member through the charging station, exposure station and developing station in succession to cause charging of a portion of the image bearing member at the charging station, the forming of a latent electrostatic image at the charged portion at the exposure station, and the developing of the latent image at the developing station;

a source which selectively generates a stop signal;

a controller responsive to the stop signal to stop the charging immediately and to thereafter stop at least a portion of the developing only after at least the charged portion of the image bearing member has been driven through the developing station to develop the latent image and to thereafter stop the image bearing member from being driven, wherein the developing station comprises a source of a DC bias and a source of an AC bias superimposed on the DC bias, and the controller stops only the AC bias at the same time as stopping the charging and stops the DC bias only after at least the charged portion of the image bearing member has been driven through the developing station.

2. An image forming apparatus as in claim 1 in which the source generates the stop signal in response to detecting an irregular state during an image forming process.

3. An image forming apparatus as in claim 2 in which the irregular state is a sheet jam.

4. An image forming apparatus as in claim 2 in which the irregular state is the opening of a door of the apparatus.

5. An image forming apparatus as in claim 1 in which the image bearing member comprises a photoconductive drum.

6. An image forming apparatus as in claim 5 in which the image bearing member further comprises a flywheel and a shaft on which the drum and flywheel are mounted to rotate therewith.

7. An image forming apparatus comprising:

means for charging, means for exposing, and means for developing positioned as respective stations;

means for bearing an image;

means for driving the image bearing means through the charging means, exposure means and developing means in succession to cause charging of a portion of the image bearing means at the charging means, the forming of a latent electrostatic image at the charged portion at the exposure means, and the developing of the latent image at the developing means;

means for selectively generating a stop signal;

means for controlling responsive to the stop signal to stop at least a portion of the charging immediately and to thereafter stop the developing only after at least the charged portion of the image bearing means has been driven through the developing means to develop the latent image and to thereafter stop the image bearing means from being driven, wherein the developing means comprises means for producing a DC bias and means for producing an AC bias superimposed on the DC bias, and the control means stops only the AC bias at the same time as stopping the charging and stops the DC bias only after at least the charged portion of the image bearing means has been driven through the developing station.

8. An image forming apparatus as in claim 7 in which the means for generating generates the stop signal in response to detecting an irregular state during an image forming process.

9. An image forming apparatus as in claim 8 in which the irregular state is a sheet jam.

10. An image forming apparatus as in claim 8 in which the irregular state is the opening of a door of the apparatus.

11. An image forming apparatus as in claim 9 in which the means for bearing an image comprises a photoconductive drum means.

12. An image forming apparatus as in claim 11 in which the means for bearing an image further comprises a flywheel means and a shaft means on which a drum means and flywheel means are mounted to rotate therewith.

13. A method for preventing needless movement of toner to an image bearing member when stopping an image forming process, comprising the steps of:

moving an image bearing member in a selected direction;

charging a surface of the image bearing member at a charging position;

forming an electrostatic latent image on the charged image bearing member;

developing the latent image formed on the surface of the image bearing member, at a developing position which is spaced from the charging position;

providing a stop signal;

generating a DC bias and an AC bias superimposed on the DC bias;

stopping the charging and only the AC bias in response to the stop signal;

moving the image bearing member relative to the developing position by at least the distance from the charging position to the developing position along the image bearing member and thereafter stopping the DC bias.

14. A method as in claim 13 in which the stopping of the image bearing member movement occurs after the stopping of the developing.

15. A method as in claim 14 in which the irregular state is a sheet jam.

16. A method as in claim 14 in which the irregular state is the opening of a door of the apparatus.

17. A method as in claim 13 in which the source generates the stop signal in response to detecting an irregular state during an image forming process.

18. A method as in claim 13 in which the image bearing member comprises a photoconductive drum.

19. A method as in claim 18 in which the image bearing member further comprises a flywheel and a shaft on which the drum and flywheel are mounted to rotate therewith.

* * * * *